US008830252B2

(12) United States Patent
Liao et al.

(10) Patent No.: US 8,830,252 B2
(45) Date of Patent: Sep. 9, 2014

(54) COLOR TEMPERATURE COMPENSATION METHOD AND APPLICATIONS THEREOF

(75) Inventors: Yen-Tao Liao, Hsinchu (TW); Sheng-Wen Cheng, Changhua (TW)

(73) Assignee: Au Optronics Corporation, Hsinchu (TW)

( * ) Notice: Subject to any disclaimer, the term of this patent is extended or adjusted under 35 U.S.C. 154(b) by 520 days.

(21) Appl. No.: 12/962,665

(22) Filed: Dec. 8, 2010

(65) Prior Publication Data

US 2012/0050340 A1 Mar. 1, 2012

(30) Foreign Application Priority Data

Sep. 1, 2010 (TW) ..... 99129523 A

(51) Int. Cl.
*G09G 5/02* (2006.01)
*G09G 3/20* (2006.01)

(52) U.S. Cl.
CPC ..... *G09G 3/2003* (2013.01); *G09G 2320/0276* (2013.01); *G09G 2300/0452* (2013.01)
USPC ..... 345/589; 345/601

(58) Field of Classification Search
USPC ..... 345/589, 590, 593, 595, 601–604
See application file for complete search history.

(56) References Cited

U.S. PATENT DOCUMENTS

| | | | | |
|---|---|---|---|---|
| 8,207,682 | B2 | 6/2012 | Lan et al. | |
| 8,384,731 | B2 * | 2/2013 | Hsieh et al. | 345/589 |
| 2004/0222999 | A1 | 11/2004 | Choi et al. | |
| 2006/0214942 | A1 | 9/2006 | Tanase et al. | |
| 2007/0064422 | A1 * | 3/2007 | Murai | 362/231 |
| 2009/0174638 | A1 | 7/2009 | Brown Elliott et al. | |
| 2010/0127638 | A1 | 5/2010 | Lan et al. | |
| 2011/0018891 | A1 * | 1/2011 | Peng et al. | 345/589 |

FOREIGN PATENT DOCUMENTS

| | | |
|---|---|---|
| TW | 200605014 | 2/2006 |
| TW | 200807391 | 2/2008 |
| TW | 201021618 | 6/2010 |

* cited by examiner

*Primary Examiner* — Amr Awad
*Assistant Examiner* — Aaron Midkiff
(74) *Attorney, Agent, or Firm* — Jianq Chyun IP Office

(57) ABSTRACT

A color-temperature-compensation (CTC) method and applications thereof are provided, and which includes determining intensities of weights of three colors in an inputted three-dimension color signal; if yes, performing a lookup table mechanism to find-out a first set of multi-primary-color (MPC) signal corresponding to the three colors with the same weights, and performing a digital-gamma-correction (DGC) to the first set of MPC signal for providing a first set of CTC signal accordingly; if no, performing the lookup table mechanism to find-out a second set of MPC signal corresponding to the three colors with different weights, and performing the DGC to the second set of MPC signal for providing a second set of CTC signal accordingly; and making at least one same color with the same intensity in the three colors with the same weights and in the three colors with different weights displaying on an MPC display have different brightness.

9 Claims, 4 Drawing Sheets

| Three-dimension signal | | | Multi-primary-color signal | | | |
|---|---|---|---|---|---|---|
| R | G | B | R | G | B | W/C/M |
| 0 | 0 | 0 | 0 | 0 | 0 | 0 |
| 0 | 0 | 32 | 0 | 0 | 291 | 0 |
| ... | ... | ... | ... | ... | ... | ... |
| 0 | 128 | 64 | 0 | 512 | 336 | 0 |
| ... | ... | ... | ... | ... | ... | ... |
| 32 | 32 | 32 | 128 | 128 | 128 | 128 |
| ... | ... | ... | ... | ... | ... | ... |
| 128 | 0 | 192 | 512 | 0 | 876 | 0 |
| 128 | 128 | 128 | 512 | 512 | 512 | 512 |
| ... | ... | ... | ... | ... | ... | ... |
| ... | ... | ... | ... | ... | ... | ... |
| 255 | 255 | 224 | 1023 | 1023 | 893 | 968 |
| 255 | 255 | 255 | 1023 | 1023 | 1023 | 1023 |

| Three-dimension signal | | | Multi-primary-color signal | | | |
|---|---|---|---|---|---|---|
| R | G | B | R | G | B | W/C/M |
| 0 | 0 | 0 | 0 | 0 | 0 | 0 |
| 0 | 0 | 32 | 0 | 0 | 291 | 0 |
| ... | ... | ... | ... | ... | ... | ... |
| 0 | 128 | 64 | 0 | 512 | 336 | 0 |
| ... | ... | ... | ... | ... | ... | ... |
| 32 | 32 | 32 | 128 | 128 | 128 | 128 |
| ... | ... | ... | ... | ... | ... | ... |
| 128 | 0 | 192 | 512 | 0 | 876 | 0 |
| 128 | 128 | 128 | 512 | 512 | 512 | 512 |
| ... | ... | ... | ... | ... | ... | ... |
| ... | ... | ... | ... | ... | ... | ... |
| 255 | 255 | 224 | 1023 | 1023 | 893 | 968 |
| 255 | 255 | 255 | 1023 | 1023 | 1023 | 1023 |

FIG. 2

| Intensity of weight of blue color in multi-primary-color signal | Intensity of weight of blue color in color temperature compensation signal |
|---|---|
| 0 | 0 |
| 1 | 0 |
| 2 | 0 |
| ... | ... |
| ... | ... |
| 512 | 216 |
| ... | ... |
| 1023 | 1008 |

FIG. 3

COLOR TEMPERATURE COMPENSATION METHOD AND APPLICATIONS THEREOF

CROSS-REFERENCE TO RELATED APPLICATION

This application claims the priority benefit of Taiwan application serial no. 99129523, filed on Sep. 1, 2010. The entirety of the above-mentioned patent application is hereby incorporated by reference herein and made a part of this specification.

BACKGROUND OF THE INVENTION

1. Field of the Invention

The present invention relates to a color temperature compensation technology, more particularly, to a color temperature compensation method and applications thereof for a multi-primary-color display.

2. Description of the Related Art

Following the vigorous development in semiconductor technology, portable electronics and flat display products have become popular in recent years. Among various types of flat displays, liquid crystal displays (LCD) have become the main stream products due to its low voltage operation, no radiation, light weight and small size.

In order to increase the color gamut of the LCD recently, a multi-primary-color display is developed. Compared with the past for the three primary colors display which using three colors of red, green and blue to achieve the purpose of color mixing, the multi-primary-color display uses four or more colors to achieve the purpose of color mixing. Accordingly, the multi-primary-color may have wider color gamut.

In general, all of LCDs have to perform the color temperature compensation before they leave the factory, so as to keep the white color temperature of the LCDs at a specific range of color temperature, for example, 6500±500° K for computer LCD monitors or 11000±500° K for LCD TVs. In practical, taking a multi-primary-color display which using four colors of red (R), green (G), blue (B) and white (W) to achieve the purpose of color mixing for an example, the white color temperature of such multi-primary-color display, which has preformed the color temperature compensation, can be kept at the specific range of color temperature by generally reducing the brightness of weights of blue color (i.e. grayscales of blue color).

However, since a blue gamma curve corresponding to the reduced weights of blue color is substantially different from a standard gamma curve which is to be displayed (e.g. Gamma 2.2), such that the images displayed on the multi-primary-color display, which has preformed the color temperature compensation, mostly have a phenomenon of poor blue (i.e. the weights of blue color may distort), and thus making the multi-primary-color display, which has preformed the color temperature compensation, have a problem of "color shift".

SUMMARY OF THE INVENTION

The present invention is directed to a color temperature compensation method and applications thereof, which can resolve the problem recited in the related art.

The present invention provides a color temperature compensation method including determining intensities of weights of three colors in an inputted three-dimension color signal; when the intensities of the weights of the three colors are the same, performing a lookup table mechanism to find out a first set of multi-primary-color signal corresponding to the three colors with the same weights, and performing a digital gamma correction to the first set of multi-primary-color signal, so as to provide a first set of color temperature compensation signal accordingly; when the intensities of the weights of the three colors are different, performing the lookup table mechanism to find out a second set of multi-primary-color signal corresponding to the three colors with different weights, and performing the digital gamma correction to the second set of multi-primary-color signal, so as to provide a second set of color temperature compensation signal accordingly; and making at least one same color with the same weight in the three colors with the same weights and in the three colors with different weights displaying on a multi-primary-color display have different brightness.

The present invention also provides a timing controller which is used for performing the above color temperature compensation method.

The present invention further provides a multi-primary-color display having the above timing controller.

From the above, the color temperature compensation method provided by the present invention is adapted for a multi-primary-color display having three primary colors (i.e. red, green and blue) and a specific color with the weights of blue color (e.g. cyan, magenta . . . etc.). The color temperature compensation method provided by the present invention mainly enhances the weights of blue color in the frames excluding the pure white frames displayed on the multi-primary-color, so as to make the blue color with the same weight displaying on the multi-primary-color display have the different brightness (i.e. in the condition of the same weights of blue color in the pure and impure white frames). Accordingly, even though the multi-primary-color display has performed the color temperature compensation, the images displaying on the multi-primary-color display do not have the phenomenon of poor blue (i.e. the weights of blue color may not distort), and thus effectively resolving the problem of "color shift" in the multi-primary-color display. In the other hands, when the multi-primary-color displays the pure white frames, the white color temperature of the multi-primary-color display can be kept at the specific range of color temperature by reducing the brightness of weights of blue color, and thus achieving the purpose of color temperature compensation.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 2 is a diagram of performing a (first) lookup table mechanism according to an exemplary embodiment of the present invention.

FIG. 3 is a diagram of performing a digital gamma correction (second lookup table mechanism) according to an exemplary embodiment of the present invention.

DESCRIPTION OF THE PREFERRED EMBODIMENTS

Reference will now be made in detail to the present preferred embodiments of the invention, examples of which are illustrated in the accompanying drawings.

Figure 1:
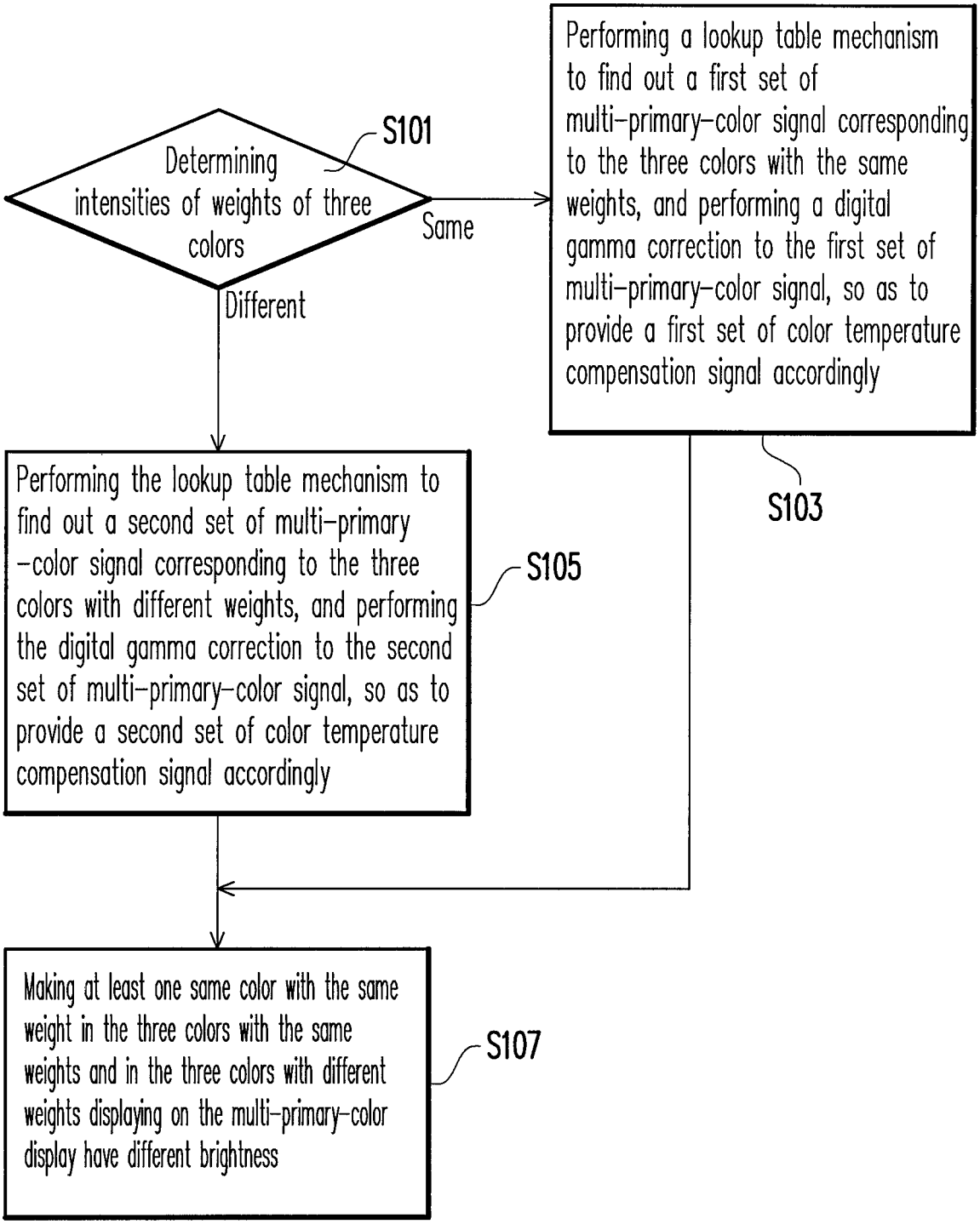
FIG. 1 is a flow chart of a color temperature compensation method according to an exemplary embodiment of the present invention.

FIG. 1 is a flow chart of a color temperature compensation method according to an exemplary embodiment of the present invention. Referring to FIG. 1, the color temperature compensation method of the exemplary embodiment is adapted for a multi-primary-color display which using four or more colors to achieve the purpose of color mixing, and may be performed by a timing controller (T-con) of the multi-primary-color display. The color temperature compensation method of the exemplary embodiment includes the following steps.

Determining intensities of weights of three colors in an inputted three-dimension color signal (step S101); when the intensities of the weights of the three colors are determined to the same in step S101, performing a lookup table mechanism to find out a first set of multi-primary-color signal corresponding to the three colors with the same weights, and performing a digital gamma correction (i.e. the color temperature compensation) to the first set of multi-primary-color signal, so as to provide a first set of color temperature compensation signal accordingly (step S103); when the intensities of the weights of the three colors are determined to different in the step S101, performing the lookup table mechanism to find out a second set of multi-primary-color signal corresponding to the three colors with different weights, and performing the digital gamma correction (i.e. the color temperature compensation) to the second set of multi-primary-color signal, so as to provide a second set of color temperature compensation signal accordingly (step S105); and making at least one same color with the same weight in the three colors with the same weights and in the three colors with different weights displaying on the multi-primary-color display have different brightness (step S107).

In the exemplary embodiment, the three colors in the inputted three-dimension color signal may include three primary colors of red (R), green (G) and blue (B), but not limited thereto. In addition, the first set and the second set of multi-primary-color signals and the first set and the second set of color temperature compensation signals may respectively have weights of four colors. Take a multi-primary-color display which using four colors of red (R), green (G), blue (B) and white (W=R+G+B) to achieve the purpose of color mixing for an example, the first set and the second set of multi-primary-color signals and the first set and the second set of color temperature compensation signals may respectively have weights of red (R), green (G), blue (B) and white (W) colors.

Accordingly, since the inputted three-dimension color signal sent from the far terminal to the timing controller has respective weights (i.e. grayscales) of three primary colors of red (R), green (G) and blue (B). Therefore, the timing controller can determine the intensities of weights of three primary colors of red (R), green (G) and blue (B) in the inputted three-dimension color signal.

When the timing controller determines that the intensities of weights of three primary colors of red (R), green (G) and blue (B) in the inputted three-dimension color signal are the same (i.e. the pure white frame), the timing controller would perform the lookup table mechanism (hereinafter "first lookup table mechanism") in a lookup table (as shown in FIG. 2) established therein in advance to find out the first set of multi-primary-color signal corresponding to the three primary colors of red (R), green (G) and blue (B) with the same weights in the inputted three-dimension color signal. For example, when the timing controller determines that the intensities of weights of three primary colors of red (R), green (G) and blue (B) in the inputted three-dimension color signal are all 32-grayscale (8-bit digital signal), the timing controller would find out the first set of multi-primary-color signal having 128-grayscale of four colors of red (R), green (G), blue (B) and white (W) (10-bit digital signal), where the grayscales value can be changed by the real design.

Then, the timing controller would perform the digital gamma correction (i.e. the color temperature compensation) to the found-out first set of multi-primary-color signal, so as to provide the first set of color temperature compensation signal to a source driver of the multi-primary-color display, and thus making the source driver drive the corresponding pixels in a display panel of the multi-primary-color display according to the first set of color temperature compensation signal.

In ideal, the timing controller would perform an another lookup table mechanism (hereinafter "second lookup table mechanism") to the first set of multi-primary-color signal having 128-grayscale of four colors of red (R), green (G), blue (B) and white (W), but since the intensity of weight of white (W) color in the first set of multi-primary-color signal does not change basically, and the intensities of respective weights of red (R) and green (G) colors in the first set of multi-primary-color signal only influences the brightness of frames slightly. Therefore, in practical, the timing controller may only perform the second lookup table mechanism to the intensity of weight of blue (B) color in the first set of multi-primary-color signal. As shown in FIG. 3, 10-bit digital signal of weight of blue (B) color in the first set of multi-primary-color signal would be changed to an another 10-bit digital signal, but the grayscale value corresponding to the changed digital signal would be lower. However, the exemplary embodiment is not limited thereto. To be specific, the exemplary embodiment also can simultaneously perform the second lookup table mechanism to the intensities of respective weights of red (R) and green (G) colors in the first set of multi-primary-color signal, but the grayscale values corresponding to the respective changed digital signals would be higher if the second lookup table mechanism is performed to the intensities of respective weights of red (R) and green (G) colors in the first set of multi-primary-color signal.

In other words, when the timing controller determines that the intensities of weights of three primary colors of red (R), green (G) and blue (B) in the inputted three-dimension color signal are the same (i.e. the pure white frame), the timing controller may reduce the intensity of weight of blue (B) color in the first set of multi-primary-color signal, so as to make the white color temperature of the multi-primary-color display may be kept at a specific range of color temperature, for example, 6500±500° K for computer LCD monitors or 11000±500° K for LCD TVs.

Figure 4:
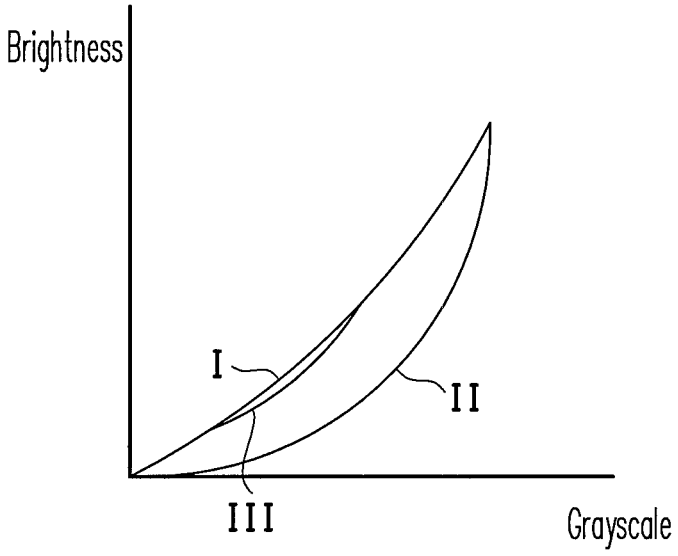
FIG. 4 is a diagram of a standard gamma curve which is to be displayed (e.g. Gamma 2.2) and a blue gamma curve which has performed the digital gamma correction and is corresponding to the reduced weights of blue color.

It can be known that when the timing controller determines that the intensities of weights of three primary colors of red (R), green (G) and blue (B) in the inputted three-dimension color signal are the same (i.e. the pure white frame), even though a blue gamma curve as shown in FIG. 4's curve II corresponding to the reduced weights of blue (B) color by performing the digital gamma correction to the first set of multi-primary-color signal through the timing controller is substantially different from a standard gamma curve which is to be displayed (e.g. Gamma 2.2, as shown in FIG. 4's curve I), but this way can be kept the white color temperature of the multi-primary-color display at the specific range of color temperature. Where, the FIG. 4's curves II and III are relating to a relationship between the respective blue grayscale values of the inputted three-dimension color signal and the brightness thereof.

In the other hands, when the timing controller determines that the intensities of weights of three primary colors of red (R), green (G) and blue (B) in the inputted three-dimension color signal are different (i.e. the impure white frame), the timing controller would perform the first lookup table mechanism in the lookup table (as shown in FIG. 2) established therein in advance to find out the second set of multi-primary-color signal corresponding to the three primary colors of red (R), green (G) and blue (B) with different weights in the inputted three-dimension color signal. For example, when the timing controller determines that the intensities of weights of three primary colors of red (R), green (G) and blue (B) in the inputted three-dimension color signal are respective to 0-grayscale, 0-grayscale and 32-grayscale (8-bit digital signal), the timing controller would find out the second set of multi-primary-color signal having 0-grayscale, 0-grayscale, 291-grayscale and 0-grayscale of four colors of red (R), green (G), blue (B) and white (W) (10-bit digital signal), where the grayscale values can be changed by the real design.

Then, the timing controller would perform the digital gamma correction (i.e. the color temperature compensation) to the found-out second set of multi-primary-color signal, so as to provide the second set of color temperature compensation signal to the source driver of the multi-primary-color display, and thus making the source driver drive the corresponding pixels in the display panel of the multi-primary-color display according to the second set of color temperature compensation signal.

Similarly, the timing controller may only perform the second lookup table mechanism to the intensity of weight of blue (B) color in the second set of multi-primary-color signal. As shown in FIG. 3, 10-bit digital signal of weight of blue (B) color in the second set of multi-primary-color signal would be changed to an another 10-bit digital signal, but the grayscale value corresponding to the changed digital signal would be lower. However, the exemplary embodiment is not limited thereto. To be specific, the exemplary embodiment also can simultaneously perform the second lookup table mechanism to the intensities of respective weights of red (R) and green (G) colors in the second set of multi-primary-color signal, but the grayscale values corresponding to the respective changed digital signals would be higher if the second lookup table mechanism is performed to the intensities of respective weights of red (R) and green (G) colors in the second set of multi-primary-color signal.

In other words, when the timing controller determines that the intensities of weights of three primary colors of red (R), green (G) and blue (B) in the inputted three-dimension color signal are different (i.e. the impure white frame), the timing controller may reduce the intensity of weight of blue (B) color in the second set of multi-primary-color signal, so as to make the blue gamma curve as shown in FIG. 4's curve III corresponding to the reduced weights of blue (B) color by performing the digital gamma correction to the second set of multi-primary-color signal through the timing controller is substantially close to the standard gamma curve which is to be displayed (e.g. Gamma 2.2, as shown in FIG. 4's curve I).

It can be known that when the timing controller determines that the intensities of weights of three primary colors of red (R), green (G) and blue (B) in the inputted three-dimension color signal are different (i.e. the impure white frame), since the blue gamma curve as shown in FIG. 4's curve III corresponding to the reduced weights of blue (B) color by performing the digital gamma correction to the second set of multi-primary-color signal through the timing controller is substantially close to the standard gamma curve which is to be displayed (e.g. Gamma 2.2, as shown in FIG. 4's curve I), such that the images displayed on the multi-primary-color display, which has performed the color temperature compensation, do not have the phenomenon of poor blue (i.e. the weights of blue (B) color may not distort), and thus making the multi-primary-color display, which has performed the color temperature compensation, does not have the problem of "color shift" recited in the related art.

To be specific, referring to FIG. 4, curve I is a standard gamma curve to be displayed (e.g. Gamma 2.2); curve II is a blue gamma curve corresponding to the reduced weights of blue (B) color by performing the digital gamma correction to the first set of multi-primary-color signal through the timing controller; and curve III is a blue gamma curve corresponding to the reduced weights of blue (B) color by performing the digital gamma correction to the second set of multi-primary-color signal through the timing controller. It can be clearly seen that, from FIG. 4, the curve III is substantially close to the curve I; and the curves I and II have a certain difference. Hence, the blue gamma curve II corresponding to the displayed pure white frames is different from the blue gamma curve III corresponding to the displayed impure white frames. Accordingly, the blue (B) color with the same weight displaying on the multi-primary-color display have the different brightness (i.e. in the condition of the same weights of blue (B) color in the pure and impure white frames).

Thereupon, users would not feel that the chromaticity coordinates of the pure white frames displayed on the multi-primary-color display, which has performed the color temperature compensation, shift from the color chromaticity value of warm color to the color chromaticity value of cool color due to the reducing of the intensities of weights (i.e. the reducing of the grayscales) of three primary colors of red (R), green (G) and blue (B) in the inputted three-dimension color signal, so as to achieve the purpose of color temperature compensation.

In the other hands, when the multi-primary-color display displays frames excluding the pure white frames, since the weight of blue (B) color in the second set of multi-primary-color signal having different weights of three colors of red (R), green (G) and blue (B) and recorded in the lookup table as show in FIG. 2 established in the timing controller in advance would be enhanced, so as to make a blue gamma curve corresponding to the reduced weights of blue color by performing the digital gamma correction to the second set of multi-primary-color signal which weight of blue (B) color has enhanced through the timing controller may be substantially close to the standard gamma curve which is to be displayed (e.g. Gamma 2.2). Accordingly, even though the multi-primary-color display has performed the color temperature compensation, the images displaying on the multi-primary-color display do not have the phenomenon of poor blue (i.e. the weights of blue (B) color may not distort), and thus effectively resolving the problem of "color shift" in the multi-primary-color display.

However, in the other exemplary embodiments of the present invention, the respective weights of red (R) and green (G) colors in the second set of multi-primary-color signal having different weights of three colors of red (R), green (G) and blue (B) would be mitigated when the multi-primary-color display displays frames excluding the pure white frames, so as to make a red and a green gamma curves respectively corresponding to the enhanced weights of red (R) and green (G) colors by performing the digital gamma correction to the second set of multi-primary-color signal through the timing controller may further be substantially close to the standard gamma curve which is to be displayed (e.g. Gamma 2.2).

Accordingly, when the color temperature compensation method of the exemplary embodiment is adapted for a multi-primary-color display which using four colors of red (R), green (G), blue (B) and white (W) to achieve the purpose of color mixing and which backlight module would provide white backlight source, the step S107 of "making at least one same color with the same weight in the three colors with the same weights and in the three colors with different weights displaying on the multi-primary-color display have different brightness" may include the steps of making the red color with the same weight in the three colors with the same weights and in the three colors with different weights displaying on the multi-primary-color display have the same brightness or have different brightness; making the green color with the same weight in the three colors with the same weights and in the three colors with different weights displaying on the multi-primary-color display have the same brightness or have different brightness; and making the blue (B) color with the same weight in the three colors with the same weights and in the three colors with different weights displaying on the multi-primary-color display have the different brightness.

Even though the above exemplary embodiments are taken a multi-primary-color display which using four colors of red (R), green (G), blue (B) and white (W) to achieve the purpose of color mixing for examples, but the present invention is not limited thereto. To be specific, in the other exemplary embodiments of the present invention, the color temperature compensation method may be also adapted for a multi-primary-color display which using four colors of red (R), green (G), blue (B) and cyan (C=G+B) to achieve the purpose of color mixing, or adapted for a multi-primary-color display which using four colors of red (R), green (G), blue (B) and magenta (M=R+B) to achieve the purpose of color mixing. Accordingly, the first set and the second set of multi-primary-color signals and the first set and the second set of color temperature compensation signals may respectively have weights of red (R), green (G), blue (B) and cyan (C) colors, or may respectively have weights of red (R), green (G), blue (B) and magenta (M) colors.

Similarly, When the timing controller determines that the intensities of weights of three primary colors of red (R), green (G) and blue (B) in the inputted three-dimension color signal are the same (i.e. the pure white frame), the timing controller may reduce the intensity of weight of blue (B) color in the first set of multi-primary-color signal as the above exemplary embodiments, so as to make the white color temperature of the multi-primary-color display may by kept at a specific range of color temperature. In addition, when the timing controller determines that the intensities of weights of three primary colors of red (R), green (G) and blue (B) in the inputted three-dimension color signal are different (i.e. the impure white frame), the timing controller may also reduce the intensity of weight of blue (B) color in the second set of multi-primary-color signal as the above exemplary embodiments, so as to make a blue gamma curve corresponding to the reduced weights of blue (B) color may be substantially close to the standard gamma curve which is to be displayed (e.g. Gamma 2.2, as shown in FIG. 4's curve I).

However, compared with the above exemplary embodiments, if the color temperature compensation method is adapted for a multi-primary-color display which using four colors of red (R), green (G), blue (B) and cyan (C) to achieve the purpose of color mixing, the weight of green (G) color in the second set of multi-primary-color signal having different weights of three colors of red (R), green (G) and blue (B) would be mitigated when the multi-primary-color display displays frames excluding the pure white frames, so as to make a green gamma curve corresponding to the enhanced weight of green (G) color by performing the digital gamma correction to the second set of multi-primary-color signal through the timing controller may further be substantially close to the standard gamma curve which is to be displayed (e.g. Gamma 2.2).

Accordingly, the step S107 of "making at least one same color with the same weight in the three colors with the same weights and in the three colors with different weights displaying on the multi-primary-color display have different brightness" may include making the red color with the same weight in the three colors with the same weights and in the three colors with different weights displaying on the multi-primary-color display have the same brightness; making the green color with the same weight in the three colors with the same weights and in the three colors with different weights displaying on the multi-primary-color display have the same brightness or have different brightness; and making the blue color with the same weight in the three colors with the same weights and in the three colors with different weights displaying on the multi-primary-color display have the different brightness.

In the other hands, if the color temperature compensation method is adapted for a multi-primary-color display which using four colors of red (R), green (G), blue (B) and magenta (M) to achieve the purpose of color mixing, the weight of red (R) color in the second set of multi-primary-color signal having different weights of three colors of red (R), green (G) and blue (B) would be mitigated when the multi-primary-color display displays frames excluding the pure white frames, so as to make a red gamma curve corresponding to the enhanced weight of red (R) color by performing the digital gamma correction to the second set of multi-primary-color signal through the timing controller may further be substantially close to the standard gamma curve which is to be displayed (e.g. Gamma 2.2).

Accordingly, the step S107 of "making at least one same color with the same weight in the three colors with the same weights and in the three colors with different weights displaying on the multi-primary-color display have different brightness" may include making the red color with the same weight in the three colors with the same weights and in the three colors with different weights displaying on the multi-primary-color display have the same brightness or have different brightness; making the green color with the same weight in the three colors with the same weights and in the three colors with different weights displaying on the multi-primary-color display have the same brightness; and making the blue color with the same weight in the three colors with the same weights and in the three colors with different weights displaying on the multi-primary-color display have the different brightness.

Herein, as taught by the above exemplary embodiments, one person having ordinary skilled in the art may easily analogize the color temperature compensation method applying in a five or a six primary colors display having three primary colors (i.e. red, green and blue) and some specific colors with the weights of blue color, such that the detail description would be omitted.

In summary, the color temperature compensation method provided by the present invention is adapted for a multi-primary-color display having three primary colors (i.e. red, green and blue) and a specific color with the weights of blue color (e.g. cyan, magenta . . . etc.). The color temperature compensation method provided by the present invention mainly enhances the weights of blue color in the frames excluding the pure white frames displayed on the multi-primary-color, so as to make the blue color with the same weight displaying on the multi-primary-color display have the different brightness (i.e. in the condition of the same weights of blue color in the pure and impure white frames). Accordingly, even though the multi-primary-color display has performed the color temperature compensation, the images displaying on the multi-primary-color display do not have the phenomenon of poor blue (i.e. the weights of blue color may not distort), and thus effectively resolving the problem of "color shift" in the multi-primary-color display.

In the other hands, when the multi-primary-color displays the pure white frames, the whit color temperature of the multi-primary-color display can be kept at the specific range of color temperature by reducing the brightness of weights of blue color, and thus achieving the purpose of color temperature compensation. Furthermore, any device (e.g. the timing controller or other processor embedded in the display) capable of performing the color temperature compensation method provided by the present invention and application thereof (e.g. the multi-primary-color display) are falling in the scope of the present invention.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A color temperature compensation method, adapted for a multi-primary-color display, and the color temperature compensation method comprising:

determining intensities of weights of three colors in an inputted three-dimension color signal;

when the intensities of the weights of the three colors are the same, finding out a first set of multi-primary-color signal corresponding to the three colors with the same weights through a lookup table, and performing a digital gamma correction to the first set of multi-primary-color signal, so as to provide a first set of color temperature compensation signal accordingly;

when the intensities of the weights of the three colors are different, finding out a second set of multi-primary-color signal corresponding to the three colors with different weights through the lookup table, and performing the digital gamma correction to the second set of multi-primary-color signal, so as to provide a second set of color temperature compensation signal accordingly;

making at least one same color with the same weight in the three colors with the same weights and in the three colors with different weights displaying on the multi-primary-color display have different brightness; and making another one same color with the same weight in the three colors with the same weights and in the three colors with different weights displaying on the multi-primary-color display have the same brightness.

2. The color temperature compensation method according to claim 1, wherein the three colors comprise a red color, a green color and a blue color.

3. The color temperature compensation method according to claim 2, wherein the first set and the second set of multi-primary-color signals and the first set and the second set of color temperature compensation signals respectively have weights of four colors.

4. The color temperature compensation method according to claim 3, wherein the four colors comprise a red color, a green color, a blue color and a white color.

5. The color temperature compensation method according to claim 4, wherein the step of making at least one same color with the same weight in the three colors with the same weights and in the three colors with different weights displaying on the multi-primary-color display have different brightness and the step of making another one same color with the same weight in the three colors with the same weights and in the three colors with different weights displaying on the multi-primary-color display have the same brightness comprises:

making the red color with the same weight in the three colors with the same weights and in the three colors with different weights displaying on the multi-primary-color display have the same brightness or have different brightness;

making the green color with the same weight in the three colors with the same weights and in the three colors with different weights displaying on the multi-primary-color display have the same brightness or have different brightness; and making the blue color with the same weight in the three colors with the same weights and in the three colors with different weights displaying on the multi-primary-color display have the different brightness.

6. The color temperature compensation method according to claim 3, wherein the four colors comprise a red color, a green color, a blue color and a cyan color.

7. The color temperature compensation method according to claim 6, wherein the step of making at least one same color with the same weight in the three colors with the same weights and in the three colors with different weights displaying on the multi-primary-color display have different brightness and the step of making another one same color with the same weight in the three colors with the same weights and in the three colors with different weights displaying on the multi-primary-color display have the same brightness comprises:

making the red color with the same weight in the three colors with the same weights and in the three colors with different weights displaying on the multi-primary-color display have the same brightness;

making the green color with the same weight in the three colors with the same weights and in the three colors with different weights displaying on the multi-primary-color display have the same brightness or have different brightness; and making the blue color with the same weight in the three colors with the same weights and in the three colors with different weights displaying on the multi-primary-color display have the different brightness.

8. The color temperature compensation method according to claim 3, wherein the four colors comprise a red color, a green color, a blue color and a magenta color.

9. The color temperature compensation method according to claim 8, wherein the step of making at least one same color with the same weight in the three colors with the same weights and in the three colors with different weights displaying on the multi-primary-color display have different brightness and the step of making another one same color with the same weight in the three colors with the same weights and in the three colors with different weights displaying on the multi-primary-color display have the same brightness comprises:

making the red color with the same weight in the three colors with the same weights and in the three colors with different weights displaying on the multi-primary-color display have the same brightness or have different brightness;

making the green color with the same weight in the three colors with the same weights and in the three colors with different weights displaying on the multi-primary-color display have the same brightness; and making the blue color with the same weight in the three colors with the same weights and in the three colors with different weights displaying on the multi-primary-color display have the different brightness.

* * * * *